US009309747B2

(12) United States Patent
Dankers et al.

(10) Patent No.: US 9,309,747 B2
(45) Date of Patent: Apr. 12, 2016

(54) SYSTEM AND METHOD FOR GENERATING PROFILE-BASED ALERTS/ALARMS

(75) Inventors: Stephan Dankers, Lower Saxony (DE); Daniel Moos, Palo Alto, CA (US)

(73) Assignee: BAKER HUGHES INCORPORATED, Houston, TX (US)

( * ) Notice: Subject to any disclaimer, the term of this patent is extended or adjusted under 35 U.S.C. 154(b) by 483 days.

(21) Appl. No.: 13/618,011

(22) Filed: Sep. 14, 2012

(65) Prior Publication Data

US 2014/0077963 A1 Mar. 20, 2014

(51) Int. Cl.

| | |
|---|---|
| ***G01V 3/00*** | (2006.01) |
| ***E21B 41/00*** | (2006.01) |
| ***E21B 47/06*** | (2012.01) |
| ***E21B 47/10*** | (2012.01) |
| ***E21B 44/00*** | (2006.01) |
| *E21B 47/12* | (2012.01) |
| *G08B 21/18* | (2006.01) |

(52) U.S. Cl.

CPC ..... *E21B 41/0021* (2013.01); *E21B 44/00* (2013.01); *E21B 47/06* (2013.01); *E21B 47/10* (2013.01); *E21B 47/12* (2013.01); *G08B 21/18* (2013.01)

(58) Field of Classification Search

CPC ..... E21B 47/06; E21B 47/10; E21B 21/08; E21B 44/00

USPC ..... 340/853.1

See application file for complete search history.

(56) References Cited

U.S. PATENT DOCUMENTS

| | | | | |
|---|---|---|---|---|
| 3,785,446 | A * | 1/1974 | Fertl | E21B 47/06 175/50 |
| 4,495,604 | A * | 1/1985 | Clavier | G01V 11/00 250/256 |
| 4,833,914 | A * | 5/1989 | Rasmus | 73/152.03 |
| 5,952,569 | A * | 9/1999 | Jervis et al. | 73/152.01 |
| 6,612,382 | B2 * | 9/2003 | King | 175/40 |
| 6,820,702 | B2 * | 11/2004 | Niedermayr et al. | 175/57 |
| 7,003,439 | B2 * | 2/2006 | Aldred et al. | 703/10 |
| 7,172,037 | B2 * | 2/2007 | Dashevskiy et al. | 175/25 |
| 7,334,651 | B2 * | 2/2008 | Wu | 175/48 |
| 8,952,829 | B2 * | 2/2015 | Wessling et al. | 340/853.1 |
| 2002/0120401 | A1 * | 8/2002 | Macdonald et al. | 702/6 |
| 2004/0040746 | A1 * | 3/2004 | Niedermayr et al. | 175/38 |

(Continued)

FOREIGN PATENT DOCUMENTS

WO WO2011050957 9/2011

OTHER PUBLICATIONS

Silverman, et al. "A Satellite-Based Digital Data System for Low-Frequency Geophysical Data". Bulletin of the Seismological Society of America, vol. 79, No. 1., pp. 189-198, Feb. 1989.

(Continued)

*Primary Examiner* — Firmin Backer
*Assistant Examiner* — Adnan Aziz
(74) *Attorney, Agent, or Firm* — Cantor Colburn LLP

(57) ABSTRACT

A method of processing parameter data includes: receiving at least one alarm value for a selected interval, the at least one alarm value generated based on a comparison of estimated parameter values at one or more respective interval points with limits at the respective interval points; performing, by a processor, a statistical analysis of the at least one alarm value over the selected interval; and generating an alarm indication associated with the selected interval, the alarm indication corresponding to a result of the statistical analysis.

18 Claims, 12 Drawing Sheets

(56) References Cited

U.S. PATENT DOCUMENTS

| | | | | |
|---|---|---|---|---|
| 2005/0216197 | A1* | 9/2005 | Zamora et al. | 702/6 |
| 2009/0165548 | A1* | 7/2009 | Pop | E21B 49/008 73/152.51 |
| 2010/0211423 | A1* | 8/2010 | Hehmeyer | 705/7 |
| 2012/0097450 | A1* | 4/2012 | Wessling et al. | 175/50 |
| 2012/0199397 | A1 | 8/2012 | Wessling et al. | |
| 2014/0122047 | A1* | 5/2014 | Saldivar et al. | 703/10 |

OTHER PUBLICATIONS

Notification of Transmittal of the International Search Report and the Written Opinion of the International Searching Authority, or the Declaration; PCT/US2013/059657; Nov. 27, 2013, 16 pages.

* cited by examiner

SYSTEM AND METHOD FOR GENERATING PROFILE-BASED ALERTS/ALARMS

BACKGROUND

Common practice in pressure management services is to constantly monitor the annular pressure or its pressure gradient equivalent (ECD) at the pressure sensor position and check if the value is in the allowed pressure window. A single downhole tool is normally used to measure the annular pressure and to calculate the ECD with the true vertical depth of the tool. Thus modeling is required, in order to fill the sensor gaps.

Modern digital systems are able to calculate parameters based on physical or empirical models in intervals, in which measured sensors values are not available. Both, time and location sensor gaps can be bridged with modern digital technologies. Whereas the visualization of the modeled values is done based on the individual application, it is difficult to put them into the context of allowed operational ranges for a whole interval. If alarms need to be generated, usually a small number of points of interests (POI) from the interval is selected and put into the context of minimum and maximum allowed critical or warning values. The direct comparison of the actual value and the min/max ranges is usually visualized with traffic light colors.

SUMMARY

A method of processing parameter data includes: receiving at least one alarm value for a selected interval, the at least one alarm value generated based on a comparison of estimated parameter values at one or more respective interval points with limits at the respective interval points; performing, by a processor, a statistical analysis of the at least one alarm value over the selected interval; and generating an alarm indication associated with the selected interval, the alarm indication corresponding to a result of the statistical analysis.

A computer program product is stored on machine readable media for processing parameter data by executing machine implemented instructions. The instructions are for: receiving at least one alarm value for a selected interval, the at least one alarm value generated based on a comparison of estimated parameter values at one or more respective interval points with limits at the respective interval points; performing, by a processor, a statistical analysis of the at least one alarm value over the selected interval; and generating an alarm indication associated with the selected interval, the alarm indication corresponding to a result of the statistical analysis.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

There are provided systems and methods for generating alert or alarm indications in conjunction with downhole parameters. A data visualization and alarm method utilizes measured or modeled values in a selected interval (e.g., depth or time interval) for comparison with alarm data, such as discrete data points and/or alarm data curves, and displays the measured or modeled data in the context of one or more alarm levels (e.g., on a display screen or printed report). This allows visualizing a high resolution alarm history for every single point in an interval. The alarms can be accumulated and statistically analyzed for specified depth intervals to generate accumulated alarms, which can be used to display various kinds of information for each interval. In one embodiment, the alarm displays can be visually compacted, which allows alarm data to be shown using less space, and also allows alarm data to be shown in context with other information. The systems and methods described herein also allow for control of the level of detail that is viewed by zooming between lower resolution and high resolution displays.

In one embodiment, relatively high resolution alarm data is accumulated on a depth scale and/or time scale, by statistically analyzing alarm data over a selected interval and generating an alarm indication for that interval. Severity levels can be attached to each selected depth or time location or interval, and displayed so that times or locations at which a parameter is out of an acceptable range can be readily identified.

Figure 1:
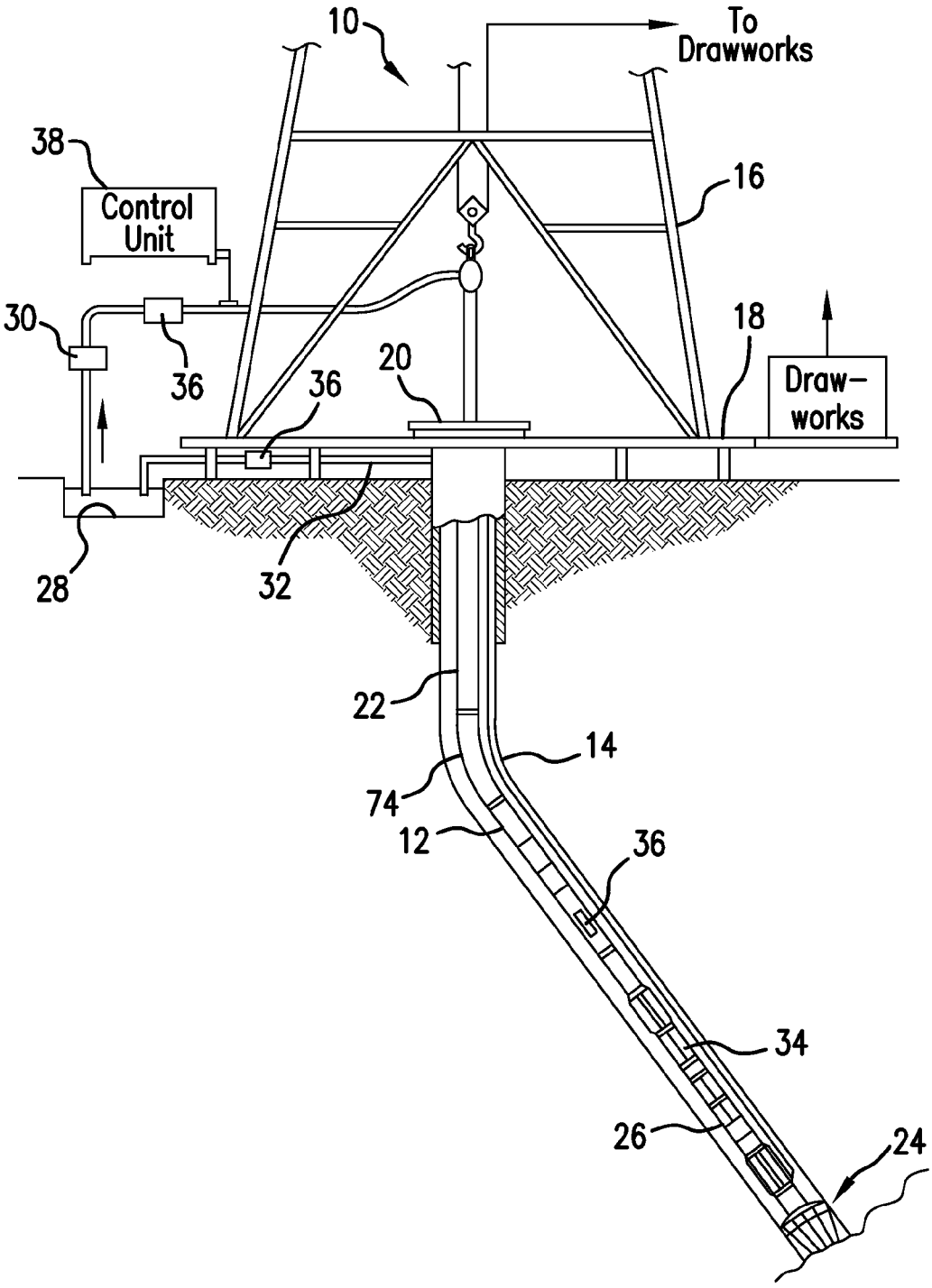
FIG. 1 is a side cross-sectional view of an embodiment of a subterranean well drilling, evaluation, exploration and/or production system.

Referring to FIG. 1, an exemplary embodiment of a well drilling, measurement, evaluation and/or production system 10 includes a borehole string 12 that is shown disposed in a borehole 14 that penetrates at least one earth formation during a downhole operation, such as a drilling, measurement and/or hydrocarbon production operation. In the embodiment shown in FIG. 1, the borehole string is configured as a drill string. However, the system 10 and borehole string 12 are not limited to the embodiments described herein, and may include any structure suitable for being lowered into a wellbore or for connecting a drill or downhole tool to the surface. For example, the borehole string 12 may be configured as coiled tubing, a wireline or a hydrocarbon production string.

In one embodiment, the system 10 includes a derrick 16 mounted on a derrick floor 18 that supports a rotary table 20 that is rotated by a prime mover at a desired rotational speed. The drill string 12 includes one or more drill pipe sections 22 or coiled tubing, and is connected to a drill bit 24 that may be rotated via the drill string 12 or using a downhole mud motor. Drilling fluid or drilling mud is pumped through the drill string 12 and/or the wellbore 14. The system 10 may also include a bottomhole assembly (BHA) 26.

During drilling operations a suitable drilling fluid 24 from, e.g., a mud pit 28 is circulated under pressure through the drill string 12 by one or more mud pumps 30. The drilling fluid 24 passes into the drill string 12 and is discharged at a wellbore bottom through the drill bit 22, and returns to the surface by advancing uphole through an annular space between the drill string 12 and the borehole wall and through a return line 32.

Various sensors and/or downhole tools may be disposed at the surface and/or in the borehole 12 to measure parameters of components of the system 10 and or downhole parameters. Such parameters include, for example, parameters of the drilling fluid 24 (e.g., flow rate and pressure), environmental parameters such as downhole temperature and pressure, operating parameters such as rotational rate, weight-on-bit (WOB) and rate of penetration (ROP), and component parameters such as stress, strain and tool condition. For example, a downhole tool 34 is incorporated into the drill string 12 and includes sensors for measuring downhole fluid flow and/or pressure in the drill string 12 and/or in the annular space to measure return fluid flow and/or pressure. Additional sensors 36 may be located at selected locations, such as an injection fluid line and/or the return line 32. Such sensors may be used, for example, to regulate fluid flow during drilling operations.

The sensors and downhole tool configurations are not limited to those described herein. The sensors and/or downhole tool 34 may be configured to provide data regarding measurements, communication with surface or downhole processors, as well as control functions. Such sensors can be deployed before, during or after drilling, e.g., via wireline, measurement-while-drilling ("MWD") or logging-while-drilling ("LWD") components. Exemplary parameters that could be measured or monitored include resistivity, density, porosity, permeability, acoustic properties, nuclear-magnetic resonance properties, formation pressures, properties or characteristics of the fluids downhole and other desired properties of the formation surrounding the borehole 14. The system 10 may further include a variety of other sensors and devices for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.)

In one embodiment, the downhole tool 34, the BHA 26 and/or the sensors 36 are in communication with a surface processing unit 38. In one embodiment, the surface processing unit 38 is configured as a surface drilling control unit which controls various production and/or drilling parameters such as rotary speed, weight-on-bit, fluid flow parameters, pumping parameters. The surface processing unit 38 may be configured to receive and process data, such as measurement data and modeling data, as well as display received and processed data. Any of various transmission media and connections, such as wired connections, fiber optic connections, wireless connections and mud pulse telemetry may be utilized to facilitate communication between system components.

The downhole tool 34, BHA 26 and/or the surface processing unit 38 may include components as necessary to provide for storing and/or processing data collected from various sensors therein. Exemplary components include, without limitation, at least one processor, storage, memory, input devices, output devices and the like.

In one embodiment, the surface processing unit 38, in conjunction with downhole and/or surface processors and sensors, is configured to operate as part of a drilling and/or pressure management system. For example, in drilling operations utilizing underbalanced, overbalanced or managed pressure drilling techniques, or other techniques that utilize drilling fluid pressure measurement and/or management, the surface processing unit 38 is configured as a processing and control unit that controls drilling parameters, such as pump speed and mud density, based on measurements of the drilling fluid flow and/or pressure in the borehole.

In one embodiment, the surface processing unit 38 (or other suitable processor) is configured to analyze measured or modeled downhole parameters and generate alarms or alerts in response to such parameters approaching or coinciding with selected limits. For example, minimum and maximum annular pressure or flow parameters for returning fluid are set based on formation parameters such as pore pressure and fracture pressure. The minimum value is either defined by the pore pressure gradient or the collapse gradient (whichever is higher at a certain depth). The maximum value is defined by the formation fracture gradient. Usually the minimum and maximum values are defined before the drilling activities start, but they can also be redefined while drilling or automatically set without human interaction. Depending on the well, the values may be either single values for the whole planned depth range of the well or curves with varying values for each depth. The minimum and maximum values define a pressure window within which annular fluid pressure should be maintained in order to maintain the integrity of the borehole during drilling and prior to deploying casing strings.

Parameters like mud density, mud rheology and flow rate, ROP are set as part of the drilling planning, so that the planned drilling pressure fits into the pressure window for the whole drilled section. When the section is actually drilled, the measured pressure from a downhole tool is available and can be compared against the pressure window values at sensor depth. Automatic alarms are generated to indicate whether the annular pressure at sensor depth is outside the pressure window.

In addition, hydraulic modeling systems allow calculating a parameter profile from top to the bottom of the wellbore and can provide pressure values along the full well path. The modeling system can use available measurements (e.g. downhole pressure, pump pressure) for calibration purposes. In a fully automated real-time system the modeled pressure profile along the well path is constantly updated. Such modeled parameter data can be periodically or continuously compared to the pressure window curves for alarm generation. For example, an initial model of the wellbore prior to drilling can be analyzed in conjunction with the pressure window curves to generate alarms or alarm indications at relevant points along the borehole path. As measurements performed during drilling are received (e.g., in real-time or near real-time), the alarm indications can be updated to provide updated information to drillers regarding possible problems. Measured and modeled parameter values are collectively referred to herein as "estimated values" or "estimated parameters."

Figure 2:
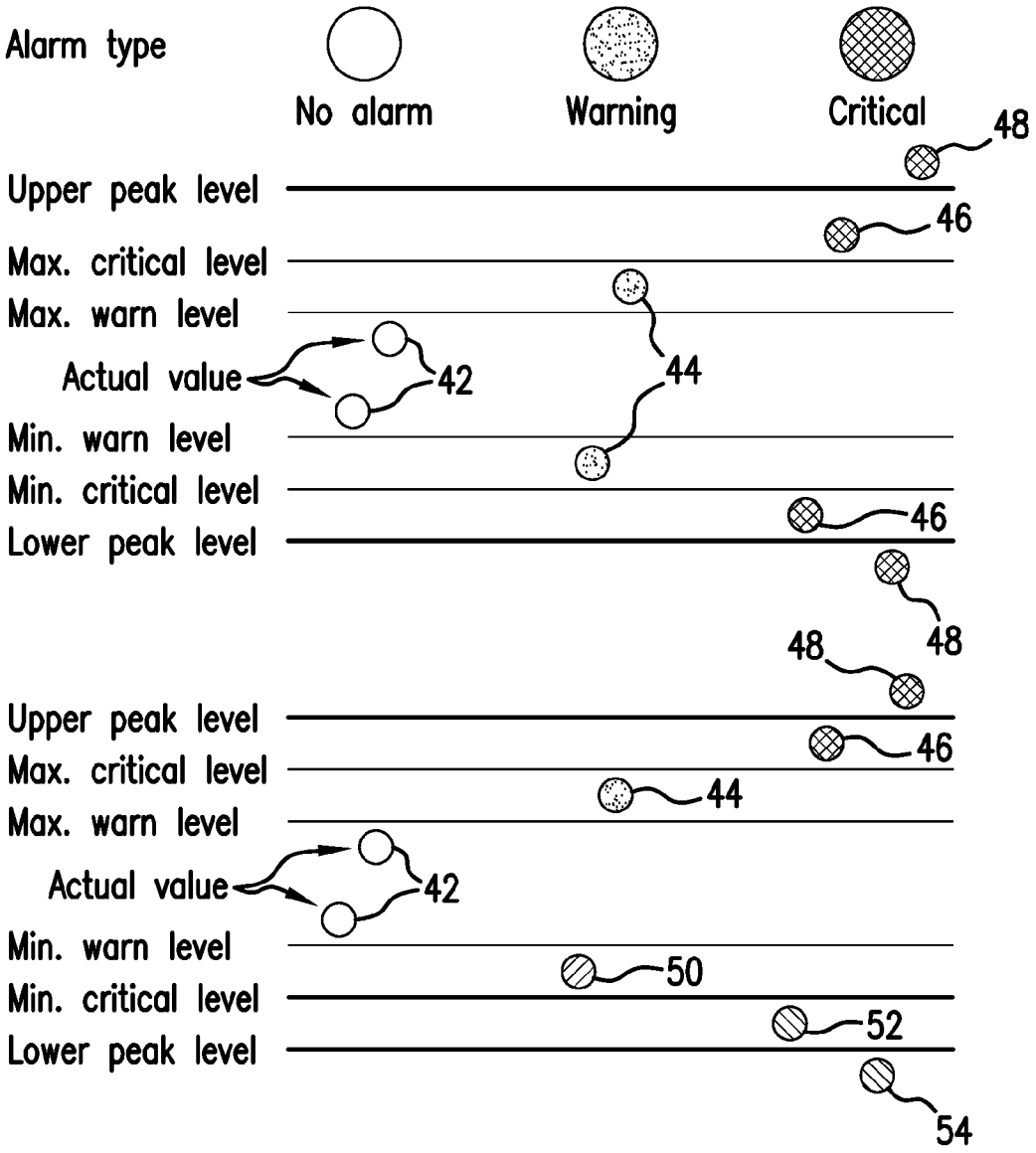
FIG. 2 illustrates exemplary visual alarms or alarm indications.

FIG. 2 illustrates examples of alarms or indicators that provide a visual indication of pressure or other parameter conditions at various borehole depths, e.g., the annular pressure relative to the set minimum and maximum values. In this example, three warning levels are provided relative to each of an upper parameter (e.g., pressure) limit and a lower parameter limit. Simple traffic light alarms are generated, comparing an actual value with given minimum and maximum warning and critical values. If the value is inside all limits usually no alarm is generated and no indication, or a green indicator symbol 42, is shown. If the value is outside warning limits but inside critical limits, the indicator color switches to yellow (symbol 44). If the value is outside the critical limits the indicator limit switches to red (symbol 46). Additional levels may be used, e.g., in order to cover very low or very high peaks at additional limits, e.g., symbols 48. Various symbol and/or color schemes may be used for the warning indications and are not limited to the embodiments described herein. For example, as shown in FIG. 2, symbols 50, 52 and 54, indicating that parameters exceed lower warning, critical and peak levels, respectively, may be provided with different colors than the upper limit indicators, in order to distinguish between lower and upper limit alarms.

Figure 3:
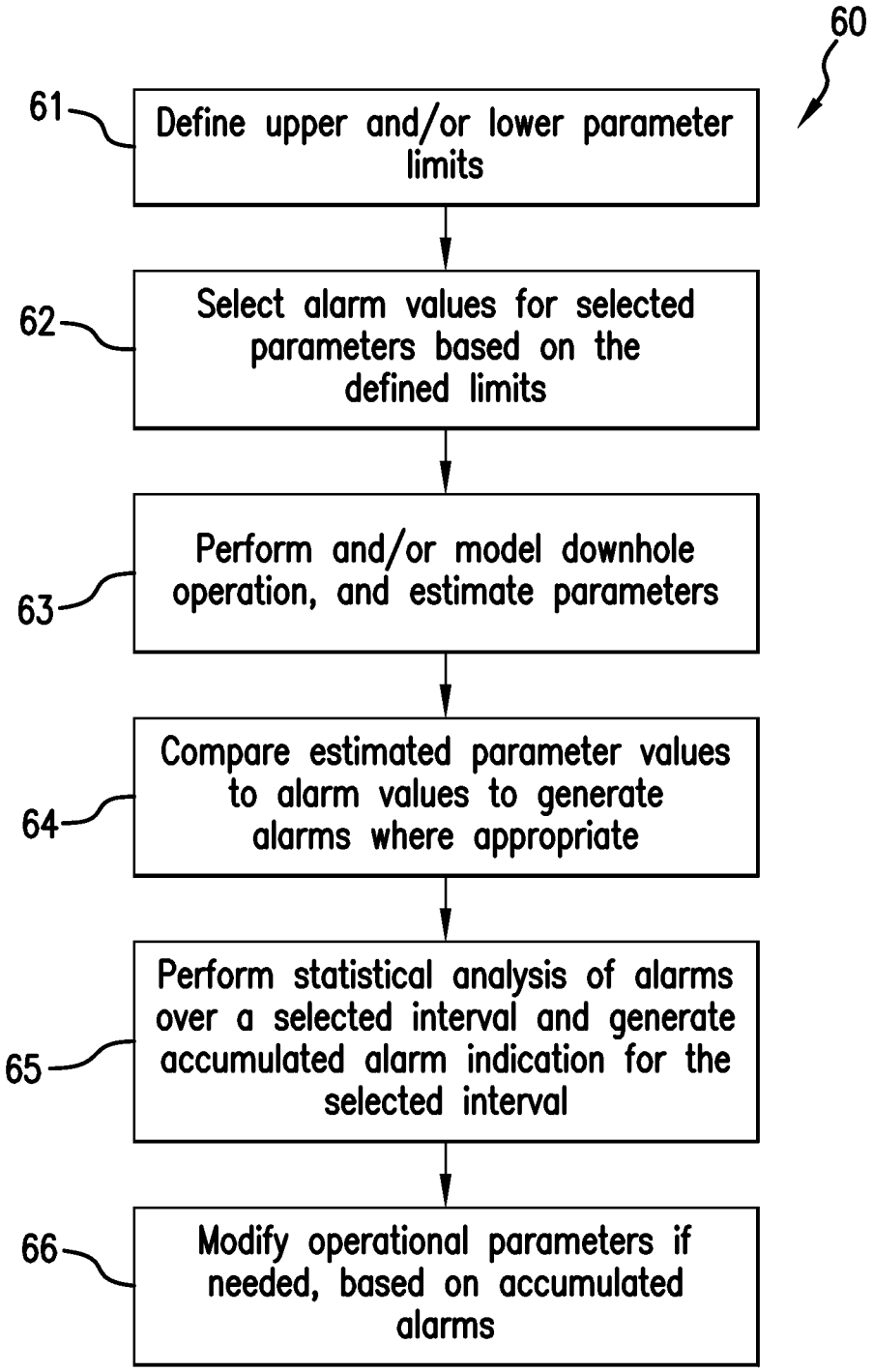
FIG. 3 is a flow diagram illustrating an embodiment of a method of drilling a wellbore and/or monitoring downhole parameters.

FIG. 3 illustrates a method 60 of drilling a wellbore and/or monitoring downhole parameters. The method 60 is used in conjunction with the system 10 and/or the surface processing unit 38, although the method 60 may be utilized in conjunction with any suitable combination of sensing devices and processors. The method 60 includes one or more stages 61-64. In one embodiment, the method 60 includes the execution of all of stages 61-64 in the order described. However, certain stages may be omitted, stages may be added, or the order of the stages changed. This method is not restricted to embodiments described herein, such as pressure management or wellbore stability services. It can be used whenever profile data along the well path needs to be put in a context of other data along the well path.

In the first stage 61, parameter limits, i.e., parameter values that define an upper and/or lower limit of acceptable parameters, are established. For example, drilling parameters are selected to plan for a drilling operation, which may include calculation of the pore pressure, the collapse gradient and/or the fracture gradient along the planned wellbore path. These values may be acquired via any suitable method. For example, seismic velocity data may be used to predict pore pressure and gradient values.

Figure 4:
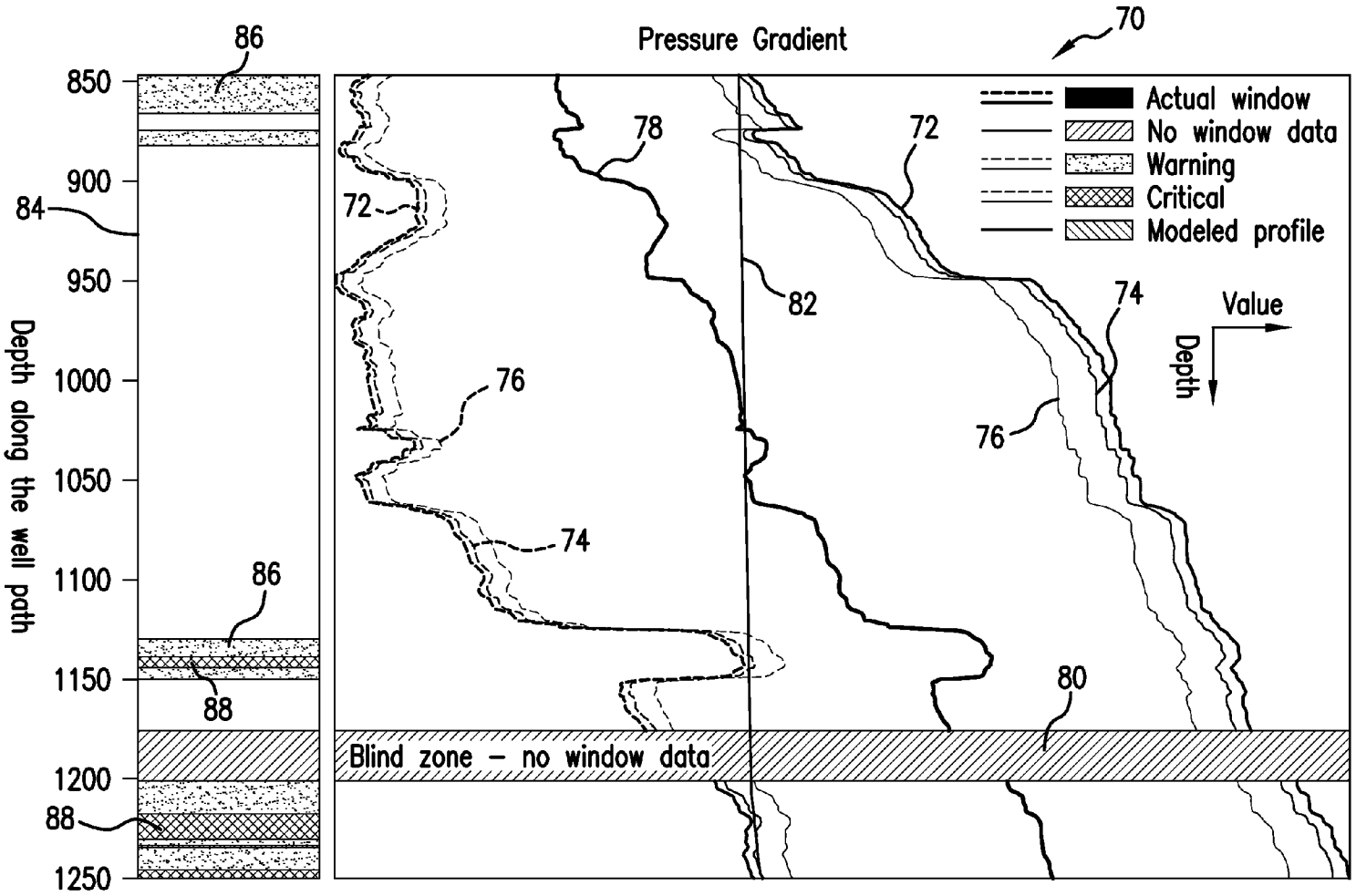
FIG. 4 shows a depth profile for exemplary parameter data and parameter limit and alert data, and a depth scale alarm display generated based on the parameter data and limit data.

In one example, upper and/or lower return fluid parameter limits are set for a plurality of points along a selected interval, such as a depth or time interval representing part or all of a borehole or planned borehole. One or more of these parameters are combined to generate upper and lower pressure limits, in order to set the lower and upper limits of a pressure window. Each limit is associated with a depth or time location or a depth or time interval. The generated limit points may be processed to produce and display one or more limit curves along the interval. FIG. 4 shows an alarm indication display 70 that includes exemplary limit curves 72 indicating upper and lower fluid pressure limits along a depth interval of a planned well. The limit curves 72 may be color coded (e.g., black)

In the second stage 62, alert or alarm values for the selected parameters are selected relative to the parameter limits. The alarm values may be values associated with discrete depth/time interval levels, or may be processed to generate curves. Alarm values and/or alarm curves are generated based on a selected relation to the parameter limits, and may be displayed with the limit values. In the example shown in FIG. 4, a first set of "critical level" alarm curves 74 (e.g., displayed in red) are set at a selected difference from the upper and lower limit curves. A second set of "warning level" curves 76 (e.g., displayed in yellow) are set at a second selected difference from the limit curves. These alert values are used by a processor and compared to estimated values to determine whether an alarm or alert should be generated.

Additional display components may also be included. For example, a window center curve 78 provides an orientation about the ideal distance from lower and upper limits. In another example, if the limits for one or more depth ranges cannot be set or can just be set for either the lower or the upper limit, this can be indicated, e.g., by a "blind zone" indication 80.

Alarms are selected and configured to be generated in response to actual or predicted pressure parameters (e.g., return fluid pressure) intersecting the limit curve or alert curves. As described herein, an "alarm" is any indication (visual or otherwise) that is associated with a specific time or depth (or time or depth interval), which indicates that one or more estimated values at the time/depth or interval exceed an acceptable value. For example, a red visual alarm such as that shown in FIG. 2 is set as a "limit alarm", indicating that an estimated value is equal to or exceeds a limit at the associated time/depth. Additional alarms may be generated based on the selected alert values. For example, a warning alarm is set to indicate that an estimated value is outside the pressure window established by the warning levels corresponding to curves 76, and a critical alarm is set to indicate that an estimated value is outside the pressure window established by the critical levels corresponding to curves 74. In one example, a yellow visual alarm is set for the warning alarm and a red alarm for the critical alarm. Based on the actual window, warning (yellow) and critical (red) limits can be derived via any suitable method (e.g. scale up/down, offset, manual, automatic). The warning and critical limits can be either inside, outside or equal to the actual window. This may be decided, e.g., by the planning or field staff based on risk assessments for a certain wellbore.

In the third stage 63, a drill string, logging string and/or production string is disposed within the wellbore 12 and a downhole operation is performed. During the operation, parameters such as fluid pressure, temperature or drilling parameters are estimated via sensor devices (e.g., the sensors 36 and/or the downhole tool 34). In one embodiment, instead of performing an actual operation, an operation can be fully or partially modeled, and parameters can be estimated based on the model.

For example, drilling hydraulic modeling systems can calculate a parameter profile, e.g.,an equivalent circulating density (ECD) profile, from the top of the wellbore down to the bottom, an example of which is shown as profile curve 82 in FIG. 4. This can be done for any type of rig activity (e.g. drilling, tripping) and also in real-time. Thus high resolution data is available on a small time scale. A high resolution discretization of both—the pressure window limits and the ECD profile—allows the direct comparison of limits and ECD data at every single discretized point. The discretization can be either equidistant or non-equidistant. It is noted that the estimated and/or modeled parameters, modeling systems, profiles and windows described herein are exemplary and not limited to the embodiments described herein. Other examples of suitable parameters include equivalent static density (ESD) and temperature (and associated pressure or temperature windows). Additional examples include dynamics models and/or measurements, such as various stresses including bending moments and side forces In the fourth stage 64, the estimated parameter value data is compared to the limit values and/or the alarm values to generate alarms where appropriate. For each depth/time at which estimated parameter data is compared to alarm data, an alarm may be generated that indicates the level of risk of the parameter exceeding the set limits. The estimated value is associated with a depth (or time) and compared to the associated limit or alarm data. For example, intersection of the estimated value with an alarm curve results in an alarm indication being generated and displayed for the depth associated with the estimated value. For those depths at which an alarm is not generated, no indication need be provided. At other depths, a yellow (warning) or red (critical) indication shows where the operation parameters came close to the operating limits (e.g., pore pressure or fracture pressure). In some embodiments, a different color coding can be used to differentiate upper and lower limits. Additional intermediate colors may be used to generate a continuous or near-continuous color coding scheme.

For example, as shown in FIG. 4, the modeled data shown by curve 82 intersects and falls below or exceeds the warning curve 76 and/or the critical curve 74 at various depths and over various depth intervals. This can be seen visually in the display 70.

In the fifth stage 65, generated alarms are analyzed over a selected interval or intervals. The alarm data is statistically analyzed over each selected interval and an alarm value or indication (referred to herein as an "accumulated alarm") is generated based on the statistical analysis. For example, FIG. 4 shows an exemplary depth scale alarm display 84 that displays alarm values for a plurality of depth intervals. For each depth interval, a single alarm indication is shown (e.g., white for no alarm, yellow for warning alarm and red for critical alarm). Each alarm indication is the result of analysis of alarm data over the associated interval relative to selected statistical criteria. The actual criteria are not limited, and may be any criteria that allows for some assessment of risk over the interval. For example, criteria may include a minimum accumulated number or percentage of estimated data points for which an alarm is generated, an average difference or ratio between the estimated data values and the alert values, a weighted mean or sum of the differences between the estimated data values and alert values, etc. To generate the depth scale 84, the estimated value profile and/or alert value profile may be discretized if necessary and each discretized point compared to the alert and limit curves.

Any suitable statistical analysis can be used to generate accumulated alarm indications for selected intervals. Examples of statistical analysis include calculation of a summation, an average, a variance, a standard deviation, t-distribution, a confidence interval, and others. Examples of data fitting include various regression methods, such as linear regression, least squares, segmented regression, hierarchal linear modeling, and others.

In the example of FIG. 4, depth intervals are selected and a criteria is selected, e.g., a minimum number of warning alarms per interval. For each interval in which a minimum number of warning alarms are met (but a minimum number of critical alarms are not met), the depth scale over that interval includes a yellow warning alarm indication 86. A red critical alarm indication 88 is displayed for each interval in which a minimum number of critical alarms are met. If desired, more colors or other visualization patterns can be used, in order to further differentiate between lower and upper limits alarms.

The depth scale alarm display 84 therefore displays not only whether an alarm was triggered over an interval, but also provides additional information, such as the number of alarms, the type of alarm and the relation between that alarm and previous conditions. The alarm and visualization method described in this stage requires only warning and critical limits, in addition to estimated values as input.

This visualization and alarm method provides a way to utilize all modeled values in an interval for alarm generation and to put them into the context of individual alarm levels.

In the sixth stage 66, operational parameters may be modified as needed, based on alert indications and/or alarms, in order to keep them within the selected parameter limits.

Figure 5:
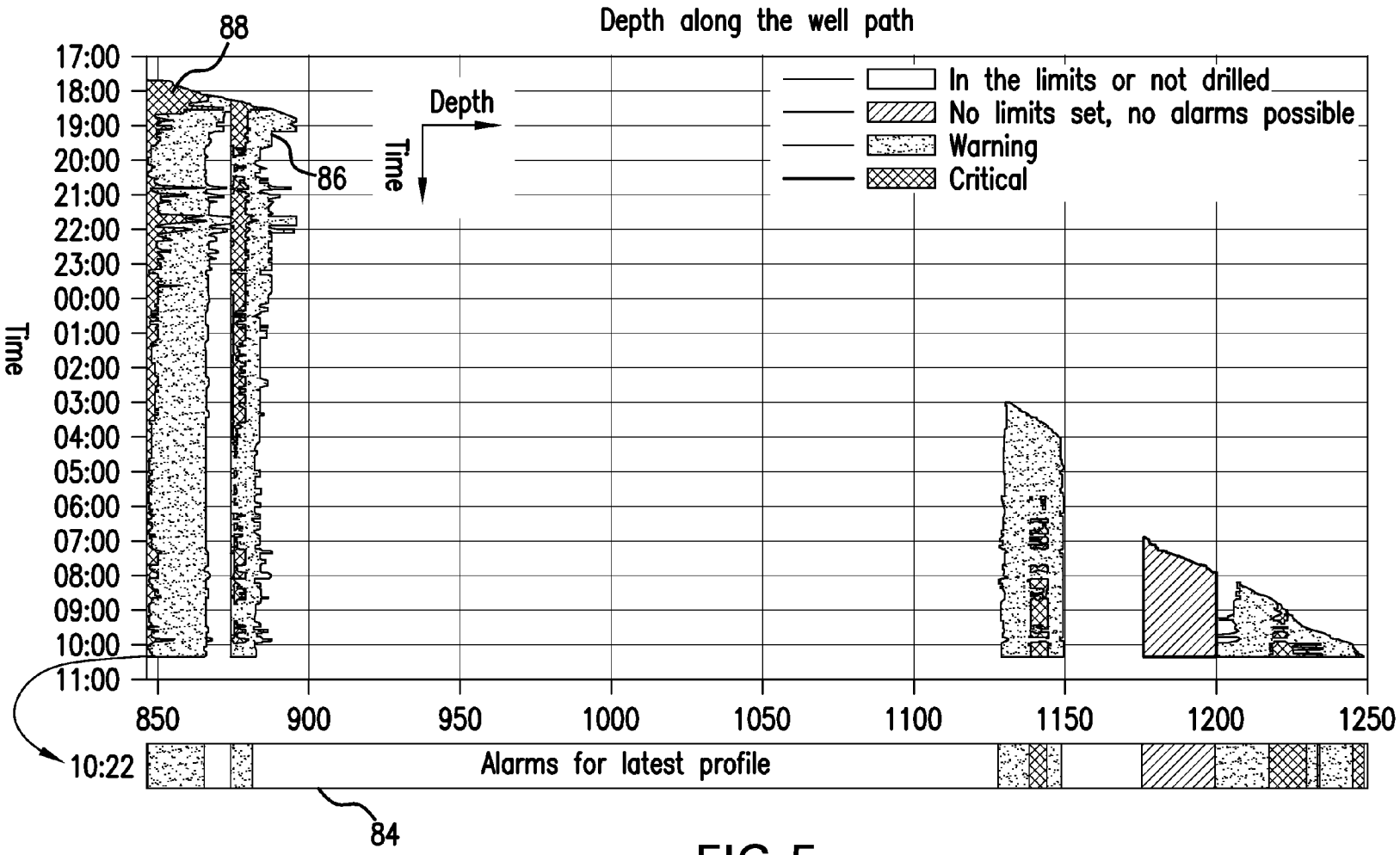
FIG. 5 shows a display including a plurality of depth scale alarm displays.

Referring to FIG. 5, in one embodiment, if multiple pressure (or other parameter) profiles are generated, each pressure profile can be compared to alert value data to generate alarm displays for each pressure profile, and the alarm displays can be displayed together. For example, as shown in FIG. 5, the displayed alarms (e.g., alarm display 84) for each single profile can be put on a time scale with the depth along the well path as the dependent parameter. This provides a very detailed visual history of the alarms at every discretized depth point and can be used to identify root causes for drilling events or to take preemptive actions, which can be especially helpful in real-time systems.

Figure 6:
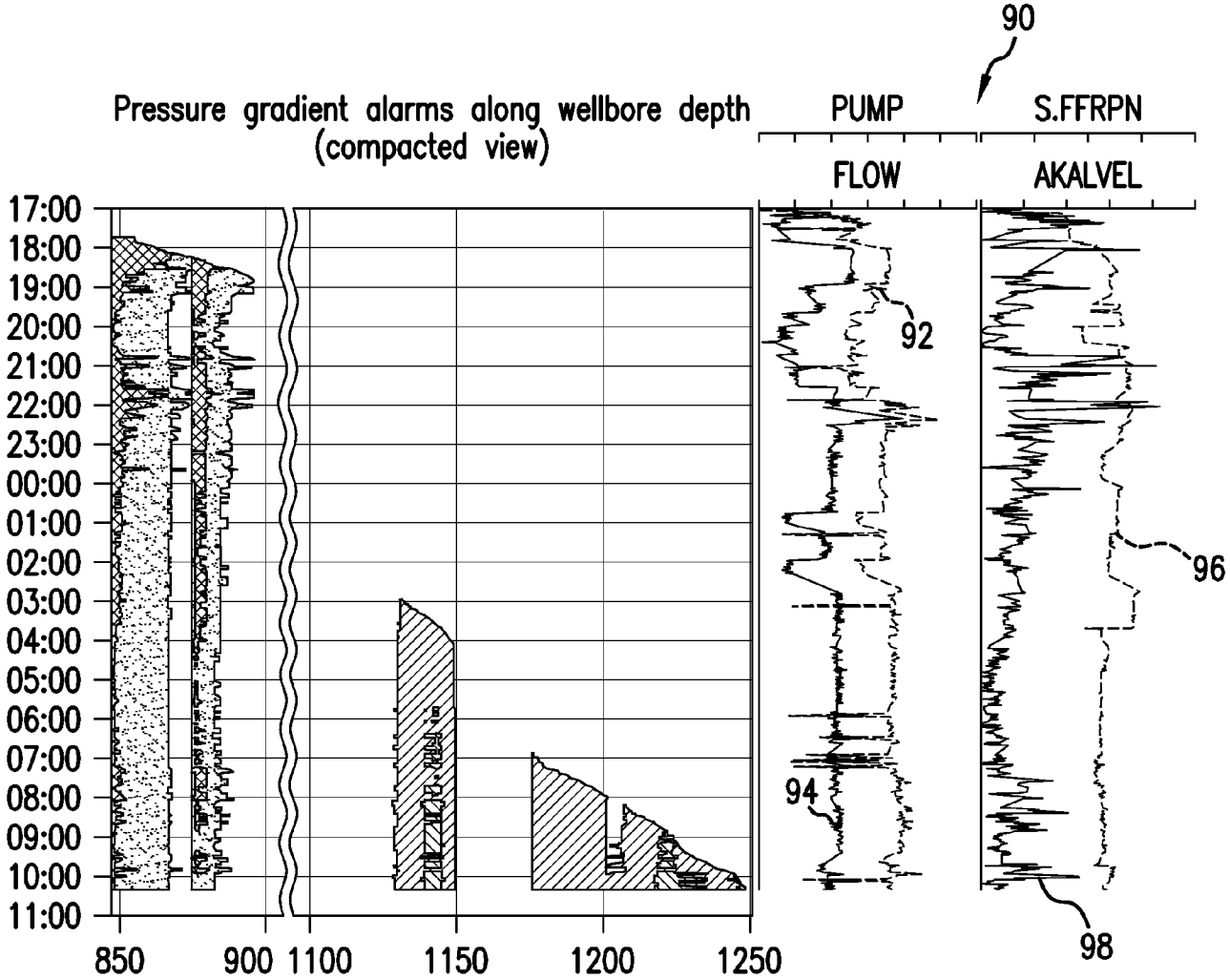
FIG. 6 shows the display of FIG. 5 including visual compaction features and additional parameter information.

Various depth ranges might not contain any displayed alarm. For example, the data shown in FIG. 5 does not include any alarm indications over the range between about 900 and 1,100 depth units. Thus, the display may be compacted, i.e., intervals within the data that do not include alarms may be removed to reduce the amount of space and data needed to display relevant information. This configuration visually hides these ranges without reducing the content of the provided information. An example of such compaction is shown in FIG. 6, in which the 900-1,100 depth unit range is removed. The space saved in the display can be used to, e.g., visualize additional information, such as contextual data shown in FIG. 6 and described below.

In one embodiment, the alarm data can be displayed with other information, which allows one to view the alarm data in the context of various other downhole parameters or conditions. For example, as shown in FIG. 6, both time-based and the depth-based alarm displays can be put into context with other drilling information, such as weight on bit, axial string velocity, RPM, drilling activity, flow rate and vibration. Exemplary contextual data 90 shown in FIG. 6 includes fluid flow data in the form of a pump pressure curve 92 and a fluid flow rate curve 94, and drilling data in the form of a drill string surface RPM curve 96 and a drill string or drill bit axial velocity curve 98.

Figure 7:
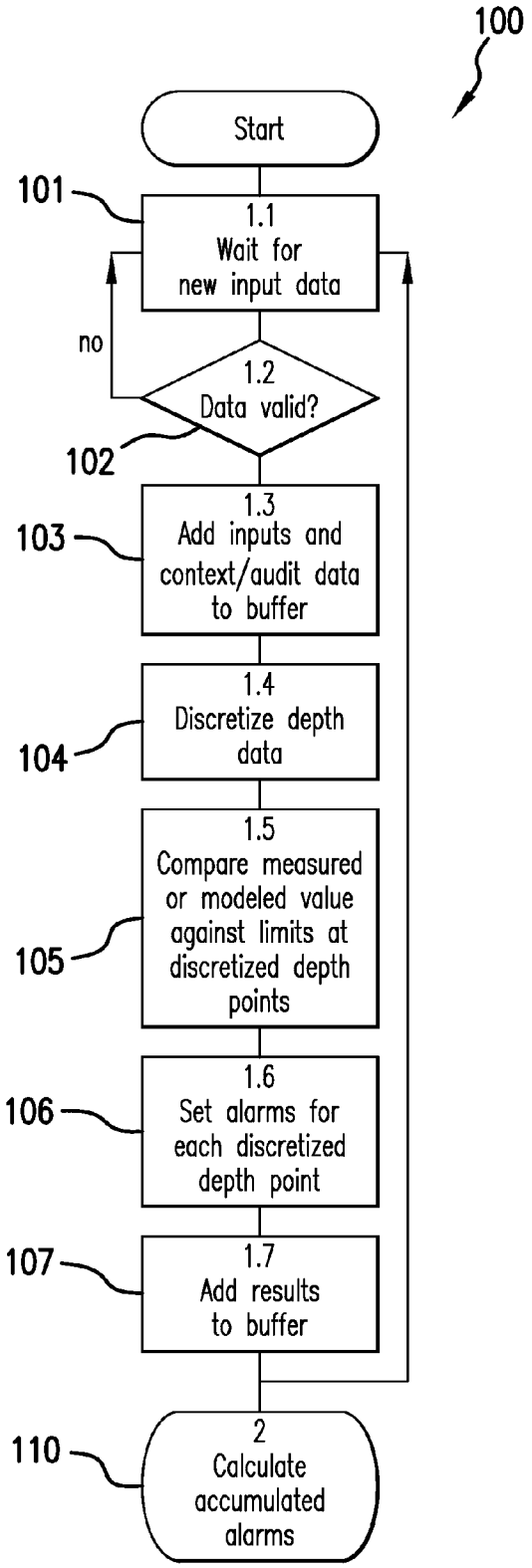
FIG. 7 is a flow diagram illustrating an embodiment of a method of generating alarm data from estimated parameter data.
Figure 8:
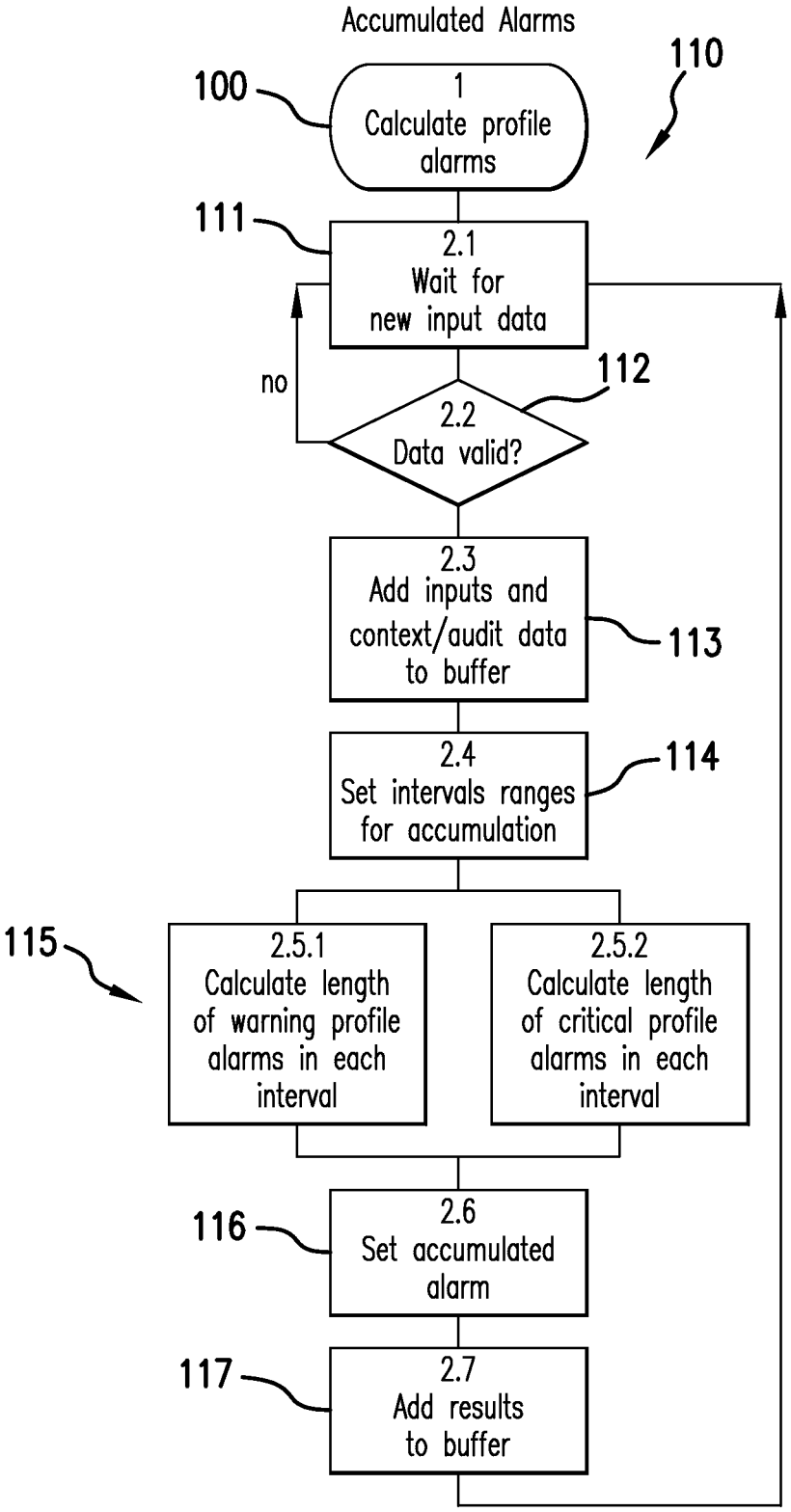
FIG. 8 is a flow diagram illustrating an embodiment of a method of generating accumulated alarm indications based on the alarm data generated from the method of FIG. 7.

FIGS. 7-10 illustrate an example of a visualization and alarm generation method. FIG. 7 shows a method 100 for generating and displaying alarms for each estimated or measured data point along a selected length of a borehole, and FIG. 8 shows a method 110 for generating "accumulated" alarm indications for intervals of the borehole length or time.

Figure 9:
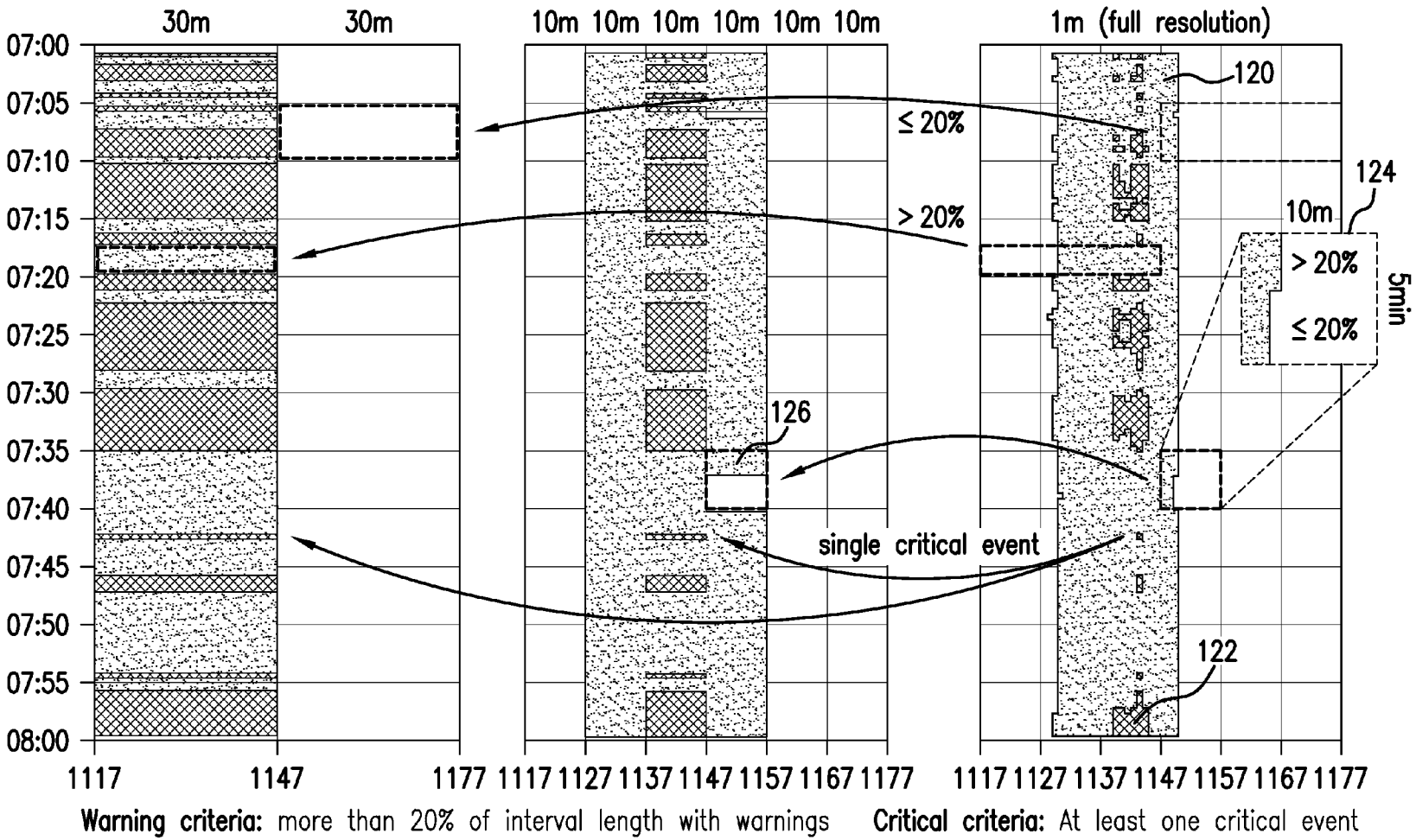
FIG. 9 illustrates an alarm data display showing alarm data and accumulated alarm indications at different resolutions.
Figure 10:
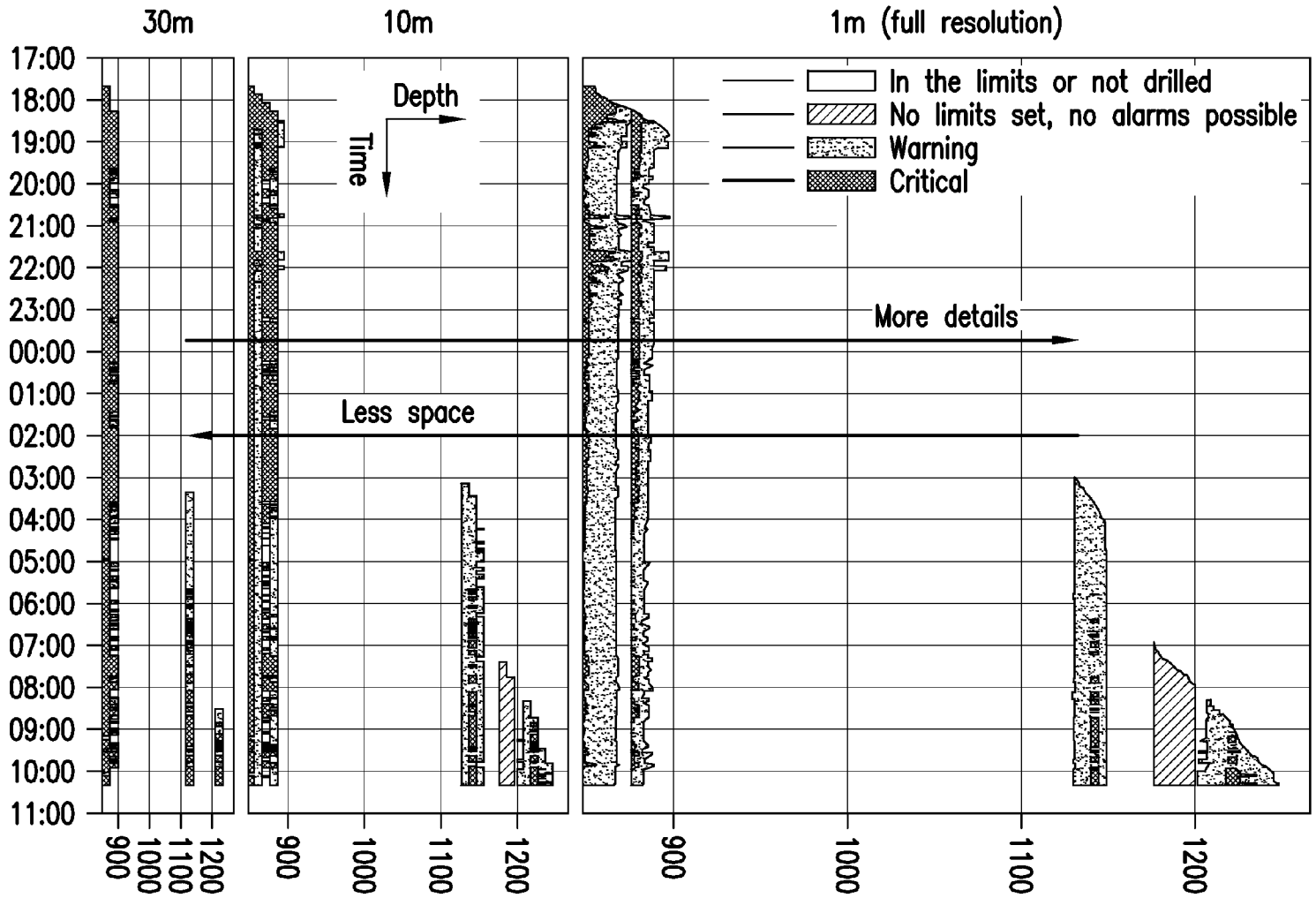
FIG. 10 is an expanded view of the alarm data display of FIG. 9.

The methods 100 and 110 are described in the context of exemplary alarm displays shown in FIGS. 9 and 10. FIGS. 9 and 10 illustrate accumulated alarm data for an exemplary drilled borehole at multiple resolutions, i.e., 1 meter, 10 meter and 30 meter resolutions. The alarm data represents comparison of estimated data along a depth of the borehole over a time frame of about 18 hours, at times ranging from about 18:00 hours to about 11:00 hours. At each time increment, measurements were made at multiple depths along the length of the borehole ranging from about 850 meters to the then-current depth of the borehole. As is evident, the range of depths increases as drilling progresses, to about 1250 meters at about 10:15 hours.

Referring to FIG. 7, at stage 101, a processor, e.g., surface processing unit 38, waits for new input data, i.e., measured and/or modeled data, from sensors in the borehole. At stage 102, the processor receives new input data and determines whether such data is valid. If the input data is valid, at stage 103, the processor adds the input data, and any additional context data, to a buffer. At stage 104, depth points are discretized and, at stage 105, the input data at each discretized depth point is compared to alert values, such as warning values shown by the warning curve 76, and critical values shown in the curve 78. At stage 106, an alarm value is set for each discretized depth point, and the results may be sent to a buffer (stage 107).

For example, referring to FIG. 9 for each time value, input data from an estimated data profile is received and depth points are discretized at an interval of one meter. For the depth points at which input data values did not meet or exceed a warning or critical value, no alarm indication is provided. For those depth points at which input data values met or exceeded a warning value, a warning alarm indication 120 is displayed. For depth points at which input data values met or exceeded a critical value, a critical alarm indication 122 is displayed.

FIG. 8 illustrates the method 110 for calculating the accumulated alarms, i.e., alarm indications associated with a selected interval that are generated based on a statistical analysis of alarms within that interval. At stage 111 a processor, e.g., surface processing unit 38, waits for new alarm data generated via the method 100. At stage 112, the processor receives the new alarm data and determines whether such data is valid. If the alarm data is valid, at stage 113, the processor adds the alarm data, and any additional context data, to a buffer. At stage 114, an accumulated interval is set, which is larger than the original interval for which the discretized depth points were generated. In the example of FIGS. 9 and 10, a larger interval of 10 meters is set.

At stage 115, a statistical analysis of the alarms within each accumulated interval is performed to generate an accumulated alarm for that interval. In the example of FIGS. 9 and 10, the following criteria are set for accumulated intervals. If one or more depth points in an accumulated interval have critical alarms, a critical alarm is set for the accumulated interval. If no critical alarms are set in the interval, but more than 20% of the depth points in the interval have warning alarms, the accumulated alarm is set as a warning alarm. If no critical alarms are set and less than 20% of the depth points have warning alarms in the interval, no alarm is set for the accumulated interval.

At stage 116, the accumulated alarm is set for each accumulated interval. At stage 117, the resulting alarms are added to the buffer.

As an illustration, FIG. 9 shows a portion of alarm data, including alarm data over an interval of 1117 meters to 1177 meters. The right-side view includes alarm data for multiple depth profiles, where alarm data is shown in initial one-meter intervals. An area 124 shows an accumulated interval of 10 meters (1147-1157 meters) and the alarm data points within. As shown, alarm data at time 07:36 shows that more than 20% of the alarm data points have a warning alarm, so an accumulated alarm 126 is set as a warning alarm for the accumulated interval. At time 07:38, less than 20% of the alarm data points have a warning alarm, and thus no alarm is set for this depth interval. An additional accumulated interval of 30 meters at time 07:38 has a warning alarm based on this criteria.

These accumulated alarms ("alarms of alarms") can condense information and allow for visually compacting the full resolution alarm data. This compaction can allow for zooming features, whereby a user can zoom out to view a lower resolution but broader display or zoom in to view higher resolution details.

Instead of setting one fixed limit (e.g. 20%) as the single criteria, more intermediate linear or non-linear limits (e.g., between 0% and 100%) can be used, in order to provide more details (e.g. five limits at 10%, 20%, 50%, 70% and 90%). These limits can be extended until a continuous color scheme with multiple colors can be applied for visualization.

Figure 11:
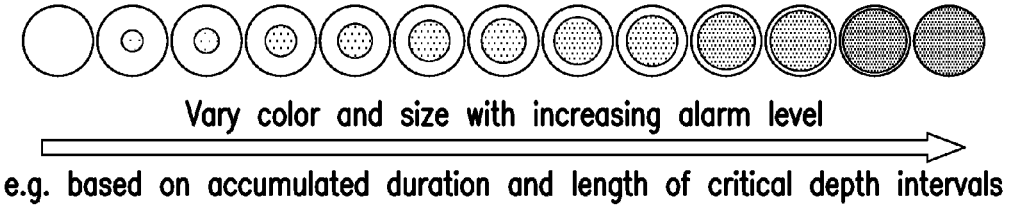
FIG. 11 illustrates exemplary alarm indications.

As shown in the above example, accumulated alarms may be compacted to a single value for each accumulated interval, which at least considers the length of intervals with critical alarms, warnings and the duration of alarms. In other embodiments, a combination of color and dot size may be used in order to visualize the single accumulated alarm. This will provide information about the alarm level and the duration at the same time. An exemplary alarm color and size scheme is shown in FIG. 11.

Figure 12:
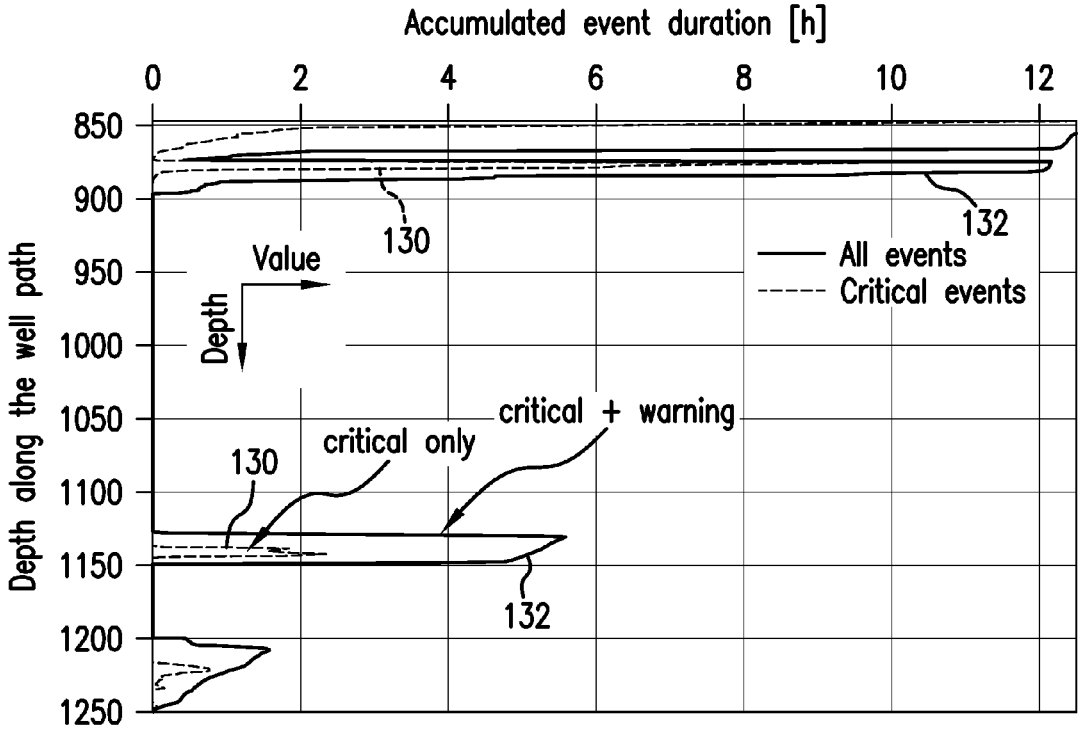
FIG. 12 illustrates an alarm display including alarm data accumulated over a time interval.

In addition or in place of accumulating alarms along the depth axis for a specific time, the detailed alarm data can also be accumulated along the time axis for a specific depth. This allows assigning severity levels to each depth based on the overall duration of alarms at a specific depth. These intervals may be statistically analyzed, e.g., summed up or averaged, to provide accumulated durations for warning and critical events. For example, FIG. 12 shows an exemplary alarm duration plot with two curves showing accumulated alarms of the data of FIG. 10 in the time domain. The red dotted curve 130 is the summed duration of critical events only and the solid curve 132 is the summed duration of events including both critical and warning events.

Figure 13:
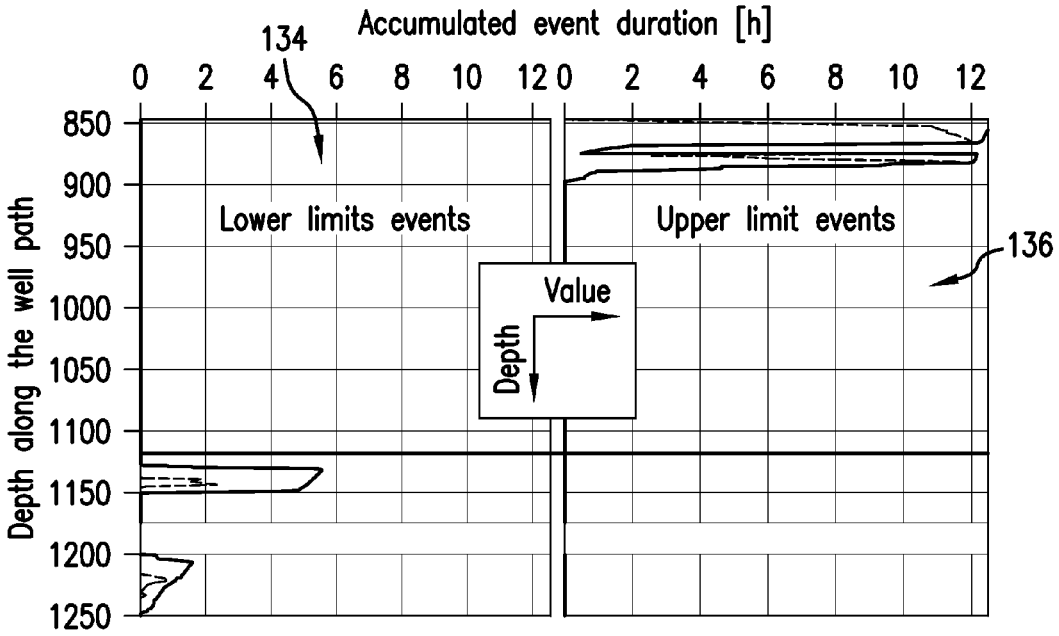
FIG. 13 illustrates the alarm display of FIG. 12, showing accumulated alarm data relative to minimum and maximum limit values.

In one embodiment, the display can be divided into multiple displays showing different kinds of events. For example, FIG. 13 includes alarm duration plots. A first plot 134 shows accumulated critical events curves and accumulated critical and warning event curves for alarms generated relative to lower limits, and plot 136 shows such curves relative to upper limits. If lower and upper limit alarms are split to two plots, more details can be provided. Based on the duration severity levels (e.g. 1, 2, 3 . . . 7) can be assigned to each depth.

Figure 14:
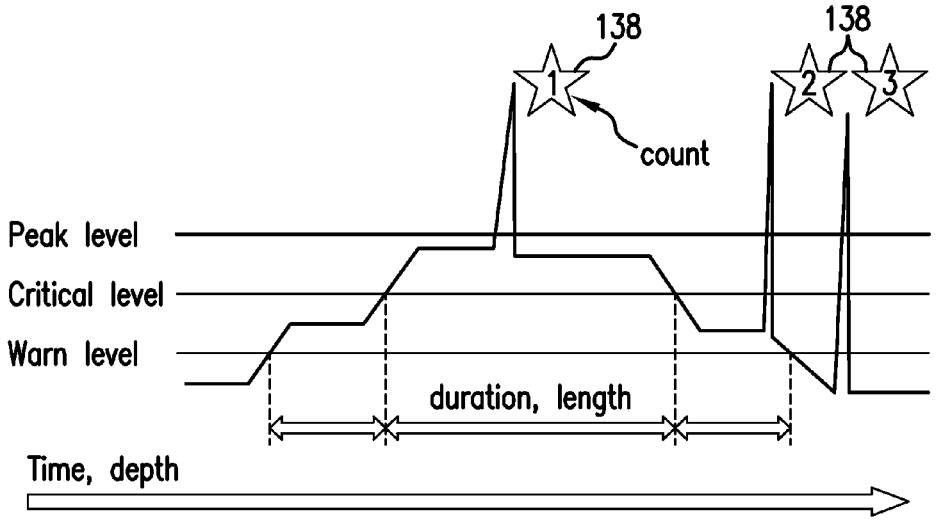
FIG. 14 illustrates parameter data peaks for which alarms may be generated.

In addition to alarms indicating depth/time duration of alarms, alarms can be set based on actual parameter measurements. For example, especially in wellbore stability and pressure management, not only the duration of alarm events is important, but also single very high or very low pressure peaks can have an impact on the stability of the formation. A third peak alarm level outside the critical alarm range (shown in FIG. 4) and peak detection are used to generate peak alarm events 138, examples of which are shown in FIG. 14. The peak alarms can be counted and the accumulated number is calculated for each discretized depth. The analysis can either be done for all peak alarms or separately for lower and upper limits. Based on the number of peak alarms, severity levels (e.g. 1, 2, 3 . . . 7) can be assigned to each depth.

Generally, some of the teachings herein are reduced to an algorithm that is stored on machine-readable media. The algorithm is implemented by a computer or processor such as the surface processing unit 38 and provides operators with desired output. For example, data may be transmitted in real time from the tool 34 or sensors 36 to the surface processing unit 38 for processing.

The systems and methods described herein provide various advantages over prior art techniques. The systems and methods described herein facilitate control over downhole parameters and monitoring of downhole intervals having depth locations for which direct measurement data is unavailable. The embodiments described herein allow for periodic or continuous monitoring of depth intervals based on array type data.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of processing parameter data, comprising:

receiving at least one alarm value for at least one of a plurality of selected intervals, the at least one alarm value generated based on a comparison of one or more estimated parameter values with at least one limit at each of the plurality of selected intervals, each alarm value being an indication that the one or more estimated parameter values has exceeded the at least one limit within a respective selected interval, wherein the estimated parameter values include estimated values of a downhole parameter associated with a downhole operation;

selecting an accumulated interval, the accumulated interval including at least the plurality of intervals;

performing, by a processor, a statistical analysis of the at least one alarm value over the accumulated interval; and generating an accumulated alarm indication associated with the accumulated interval, the alarm indication corresponding to a result of the statistical analysis and indicating the level of risk of the parameter exceeding a selected limit.

2. The method of claim 1, wherein the at least one alarm value is generated by:

selecting at least one limit value for each of a plurality of interval points, the limit value being a value of a parameter;

calculating an estimated parameter value at each of the plurality of interval locations;

comparing the estimated parameter value to the at least one limit value; and generating an alarm value for the interval points at which the estimated parameter value is within a selected range relative to the at least one limit value.

3. The method of claim 1, wherein performing the statistical analysis includes selecting statistical criteria, comparing the at least one alarm value to the criteria, and generating the alarm indication in response to one or more of the at least one alarm value satisfying the criteria.

4. The method of claim 3, wherein, each selected interval includes at least one interval point, each alarm value associated with a respective interval point.

5. The method of claim 1, wherein the statistical criteria includes at least one of: a minimum number of alarm values generated for the accumulated interval, and a minimum proportion of the accumulated interval that has selected intervals associated with a generated alarm value.

6. The method of claim 2, wherein the at least one alarm value includes a warning value generated for an interval point at which the estimated parameter value is within a first range relative to the at least one limit value, and a critical value generated for an interval point at which the estimated parameter value is within a second range relative to the at least one limit value, the second range being less than the first range.

7. The method of claim 6, wherein generating the alarm indication includes generating a critical alarm indication for the selected interval in response to the selected interval including at least one critical value.

8. The method of claim 6, wherein generating the alarm indication includes generating a warning alarm indication for the selected interval in response to the selected interval including no critical values and at least a selected minimum number of warning values.

9. The method of claim 1, wherein the selected interval is at least one of a time interval and a depth interval.

10. A computer program product stored on non-transitory machine readable media for processing parameter data by executing machine implemented instructions, the instructions for:

receiving at least one alarm value for at least one of a plurality of selected intervals, the at least one alarm value generated based on a comparison of one or more estimated parameter values with at least one limit at each of the plurality of selected intervals, each alarm value being an indication that the one or more estimated parameter values has exceeded the at least one limit within a respective selected interval, wherein the estimated parameter values include estimated values of a downhole parameter associated with a downhole operation;

selecting an accumulated interval, the accumulated interval including at least the plurality of intervals;

performing, by a processor, a statistical analysis of the at least one alarm value over the accumulated interval; and generating an accumulated alarm indication associated with the accumulated interval, the alarm indication corresponding to a result of the statistical analysis and indicating the level of risk of the parameter exceeding a selected limit.

11. The computer program product of claim 10, wherein the at least one alarm value is generated by:

selecting at least one limit value for each of a plurality of interval points, the limit value being a value of a parameter;

calculating an estimated parameter value at each of the plurality of interval locations;

comparing the estimated parameter value to the at least one limit value; and generating an alarm value for the interval points at which the estimated parameter value is within a selected range relative to the at least one limit value.

12. The computer program product of claim 10, wherein performing the statistical analysis includes selecting statistical criteria, comparing the at least one alarm value to the criteria, and generating the alarm indication in response to one or more of the at least one alarm value satisfying the criteria.

13. The computer program product of claim 12, wherein the selected interval includes a plurality of interval points, the at least one alarm value is a plurality of alarm values each associated with a respective interval point, and the at least one limit value includes a warning level and a critical level, the critical level representing a higher level of risk than the warning level.

14. The computer program product of claim 13, wherein each of the plurality of alarm values is assigned one of: a warning value based on the estimated parameter value being at least equal to the warning level, and a critical value based on the estimated parameter value being at least equal to the critical level.

15. The computer program product of claim 14, wherein generating the alarm indication includes setting the alarm indication as an accumulated warning alarm based on a selected number of the alarm values having the warning value, and setting the alarm indication as an accumulated critical alarm based on a selected number of the alarm values having the critical value.

16. The computer program product of claim 14, wherein generating the alarm indication includes setting the alarm indication as an accumulated critical alarm based on at least one alarm value having the critical value, and setting the alarm indication as an accumulated warning alarm based on a percentage of the alarm values having warning values and having no critical values.

17. The computer program product of claim 15, wherein generating the alarm indication includes displaying a first resolution in which all of the alarm values and interval points are displayed, and a second resolution in which only the accumulated warning alarm or the accumulated critical alarm is displayed for the interval.

18. The computer program product of claim 10, wherein the selected interval is at least one of a time interval and a depth interval.

* * * * *